US009691209B2

(12) United States Patent
Kodama et al.

(10) Patent No.: US 9,691,209 B2
(45) Date of Patent: Jun. 27, 2017

(54) COIN DELIVERING DEVICE

(71) Applicant: NIPPON CONLUX CO., LTD., Sakado-shi (JP)

(72) Inventors: Yasuyuki Kodama, Sakado (JP); Takahiro Hayashi, Sakado (JP); Masashi Kondo, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 0 days.

(21) Appl. No.: 15/101,454

(22) PCT Filed: Sep. 30, 2014

(86) PCT No.: PCT/JP2014/076115
§ 371 (c)(1),
(2) Date: Jun. 3, 2016

(87) PCT Pub. No.: WO2015/083423
PCT Pub. Date: Jun. 11, 2015

(65) Prior Publication Data

US 2016/0321850 A1 Nov. 3, 2016

(30) Foreign Application Priority Data

Dec. 5, 2013 (JP) ..... 2013-252140

(51) Int. Cl.
*G07D 1/02* (2006.01)
*G07D 1/06* (2006.01)
*G07D 1/00* (2006.01)

(52) U.S. Cl.
CPC ..... *G07D 1/06* (2013.01); *G07D 1/00* (2013.01); *G07D 1/02* (2013.01)

(58) Field of Classification Search
CPC ..... G07D 1/00; G07D 1/02; G07D 2201/00
See application file for complete search history.

(56) References Cited

FOREIGN PATENT DOCUMENTS

JP 50-93196 A 7/1975
JP 5093196 A * 7/1975 ..... G07D 1/00
(Continued)

OTHER PUBLICATIONS

International Preliminary Report on Patentability and Written Opinion issued Jun. 16, 2016 in PCT/JP2014/076115 (submitting English language translation only), (9 pages).
(Continued)

*Primary Examiner* — Mark Beauchaine
(74) *Attorney, Agent, or Firm* — Oblon, McClelland, Maier & Neustadt, L.L.P.

(57) ABSTRACT

A coin delivering device includes plural coin tubes, a coin base, a payout slide, a payout link, and a change slide. At least one of the coin tubes is a multiple-coin delivering coin tube from which plural coins are pulled out in one time of pulling out the payout slide. A recess portion sized for housing a coin is provided at a position corresponding to the multiple-coin delivering coin tube, on the coin base. A vertical wall portion is provided around a coin housing hole corresponding to the multiple-coin delivering coin tube, on the payout slide, protrudes to the side of the coin base, and, in a standby mode, is positioned in the recess portion of the coin base. An upper surface of the change slide corresponding to the multiple-coin delivering coin tube is positioned similar to a bottom surface of the recess portion of the coin base in height.

5 Claims, 9 Drawing Sheets

(56) References Cited

FOREIGN PATENT DOCUMENTS

| | | | | | |
|---|---|---|---|---|---|
| JP | 51-57194 | A | | 5/1976 | |
| JP | 4-192098 | A | | 7/1992 | |
| JP | 7-262426 | A | | 10/1995 | |
| JP | 11-161825 | A | | 6/1999 | |
| JP | 2013-222246 | A | | 10/2013 | |
| JP | 2013222246 | A | * | 10/2013 | ..... G07D 1/00 |

OTHER PUBLICATIONS

International Search Report Issued Nov. 25, 2014, in PCT/JP2014/076115 Filed Sep. 30, 2014, (2 pages).

* cited by examiner (a)

(b)

COIN DELIVERING DEVICE

TECHNICAL FIELD

The present invention relates to a coin processing device to be installed in a vending machine, a money changer, a fare adjustment machine, a ticket-vending machine, or a servicing apparatus (hereinafter, referred to as a "vending machine or the like"). In particular, the present invention relates to a coin delivering device included in a part of this type of coin processing device, and capable of delivering coins that have been sorted and housed each denomination, in response to an amount of change or the like.

BACKGROUND ART

Conventionally, a coin processing device that distinguishes whether inserted coins are genuine, sorts and houses, each denomination, inserted coins that have been determined as genuine coins, and further delivers the coins that have been sorted and housed, in response to an amount of change or the like, is installed inside a vending machine or the like. FIG. 6 is a schematic view of this type of coin processing device.

The coin processing device 1 mainly includes a coin sorting device 2 for distinguishing whether inserted coins are genuine and distributing the inserted coins each denomination, and a coin delivering device 3 for housing, each denomination, the inserted coins that have been distributed by the coin sorting device 2, selecting and delivering coins from the inserted coins that have been housed, in response to an amount of change or the like. The coin sorting device 2 includes a coin discriminating unit that distinguishes whether the inserted coins are genuine, and a coin distributing unit that distributes, each denomination, coins that have been determined as genuine coins by the coin discriminating unit. The coin delivering device 3 includes a coin housing unit including a plurality of coin tubes for housing, each denomination, the coins that have been distributed each denomination by the coin sorting device 2, and a coin delivering mechanism that selects and delivers coins from the coin housing unit in response to an amount of change. As the coin delivering mechanism, the following mechanism has been widely adopted. The coins that have been housed in the coin tubes are pulled out from slit holes open at bottom portions of the coin tubes, by a sliding member referred to as a payout slide. Thus, the coins are delivered. The coin housing unit included in the coin delivering device 3 typically is a cassette separable in order to easily pull out the coins when the coins in the coin delivering device 3 are collected as sales.

Coin delivering devices included in conventional coin processing devices have been disclosed in Patent Literature 1 (JP 07-262426 A) and Patent Literature 2 (JP 11-161825 A).

A structure of a conventional coin delivering device will be described below with reference to FIGS. 7 to 9.

FIGS. 7 and 8 are sectional views of a main portion of the conventional coin delivering device. FIG. 9 is a conceptual perspective view of the conventional coin delivering device, and coin tubes, walls of the device, and the like, have been omitted. FIG. 7(*a*) is the sectional view of the main portion in a state before delivery of coins is performed (hereinafter, referred to as a "standby mode"). FIG. 7(*b*) is the sectional view of the main portion in a state where a cassette in the coin housing unit has been separated. FIG. 8 is the sectional view of the main portion in a state where delivering operation of coins is performed (hereinafter, referred to as a "delivering mode"). FIG. 9 is the conceptual perspective view in the standby mode.

The conventional coin delivering device 3 illustrated in FIGS. 7 to 9 includes a driving unit not illustrated, such as a motor, a payout cam 10 that performs one rotation in one direction (a direction of arrow A) every one time of delivering operation by driving force of the driving unit, a payout link 9 that includes a groove 9*a* engaging with a pin 10*a* disposed on a lower surface of the payout cam 10 so as to protrude and that reciprocates in a direction of arrow B from an initial position in the figures when the payout cam 10 performs one rotation, and a payout slide 8 that engages with the payout link 9 through a pin 9*b* so as to be attachable and detachable (refer to FIG. 9) and that reciprocates in the direction of arrow B in response to a reciprocating motion of the payout link 9. Here, the reason why the payout link 9 and the payout slide 8 are attachable to and detachable from each other is because the payout slide 8 is included in the cassette 5 separable from a device main body 4, together with the coin housing unit.

The payout slide 8 includes a plurality of coin housing holes 8*a* each for housing only one coin out of coins housed on each of lowest surfaces of a plurality of coin tubes 6, formed thereto, in correspondence to the plurality of coin tubes 6 of the coin housing unit. A base plate (a coin base) 7 of the cassette 5 is disposed below the coin housing holes 8*a*, and supports coins housed in the coin housing holes 8*a* in the standby mode illustrated in FIG. 7(*a*).

Meanwhile, with leading ends to be provided below the respective coin housing holes 8*a* of the payout slide 8, change slides 11 for switching between delivery and non-delivery of coins each housed in each of the coin housing holes 8*a* are fitted and inserted into the payout link 9 so as to freely come out and come in, corresponding to the respective coin housing holes 8*a*. The change slides 11 operate and move in response to the payout link 9. When movements of the change slides 11 are regulated, the change slides 11 do not respond to the payout link 9.

A change lever 12 that moves in an upper and lower direction by the driving unit is disposed at a rear portion of each of the change slides 11. The change lever 12 is fitted to a leading end of a plunger of a solenoid for a change lever 13. The driving unit of the change lever 12 is constituted of the solenoid for a change lever 13. The plunger of the solenoid for a change lever 13 is pressed by a return spring in a protruding direction. The plunger is attracted in a direction opposite to the protruding direction by energization to the solenoid for a change lever 13, and returns back to an original position by attraction of the return spring when the energization to the solenoid for a change lever 13 hafts. Therefore, when the energization to the solenoid for a change lever 13 has halted, the change lever 12 fitted to the leading end of the plunder of the solenoid for a change lever 13 has a downward delivery preventing position due to pressing force of the return spring and engages with a rear end of the change slide 11 so as to regulate a movement of the change slide 11. When the energization to the solenoid for a change lever 13 has been performed, the change lever 12 moves upward and has a delivery allowing position. As a result, the engagement with the rear end of the change slide 11 is released and the movement of the change slide 11 is not regulated. A mechanism including the change slide 11, the change lever 12, and the solenoid for a change lever 13, is provided so as to correspond to each of the coin housing holes 8*a* one-to-one, and each individually operates.

In a state where having engaged with the corresponding change lever 12, as illustrated in FIG. 8(*b*), the change slide 11 does not respond to reciprocations of the payout link 9 and the payout slide 8, and retains a position in the standby mode. The change slide 11 closes a lower portion of the corresponding coin housing hole 8*a* in the delivering mode. In a state where the engagement with the corresponding change lever 12 has been released, as illustrated in FIG. 8(*a*), the change slide 11 reciprocates in response to the reciprocations of the payout link 9 and the payout slide 8. The change slide 11 opens the lower portion of the corresponding coin housing hole 8*a* in the delivering mode.

Here, as an example, a case where the coin delivering device delivers a coin only from one of coin tubes 6 corresponding to one of the coin housing holes 8*a*, will be described.

First, energization is performed to only a solenoid for a change lever 13 corresponding to the coin housing hole 8*a* for a coin to be delivered so as to move a corresponding change lever 12 upward. Accordingly, engagement between the change lever 12 and a corresponding change slide 11 is released. The change slide 11 corresponding to the coin housing hole 8*a* for a coin to be delivered can reciprocate in response to a reciprocation of the payout slide 8. On the other hand, a solenoid for a change lever 13 corresponding to each of the other coin housing holes for a coin not to be delivered, is not energized. Thus, engagement between a corresponding change lever 12 and a corresponding change slide 11 is not released, and a movement of the change slide 11 corresponding to each of the other coin housing holes 8*a* for a coin not to be delivered, is regulated.

Next, a payout cam 10 performs one rotation in the direction of arrow A by a drive of the driving unit not illustrated, such as a motor. The payout link 9 and the payout slide 8 reciprocate in the direction of arrow B. Then, individual coins housed in the respective coin housing holes 8*a* of the payout slide 8 also slide together with the payout slide 8, and move to positions out of the coin base 7 for supporting the coins housed in the coin housing holes 8*a* in the standby mode. In this case, the change slide 11 corresponding to the coin housing hole 8*a* for a coin to be delivered has slid and moved backward in response to the movements of the payout link 9 and the payout slide 8. Thus, a lower portion of the coin housing hole 8*a* opens and a coin housed in the coin housing hole 8*a* falls and is delivered. On the other hand, the movement of the change slide 11 corresponding to each of the coin housing holes 8*a* for a coin not to be delivered, has been regulated by the change lever 12. Thus, even when the payout link 9 and the payout slide 8 move, the change slide 11 retains a position in the standby mode. Therefore, when the payout link 9 and the payout slide 8 move, a leading end of the change slide 11 comes out below each of the coin housing holes 8*a*. Accordingly, the coin housed in each of the coin housing holes 8*a* is supported and the coin is not delivered.

As illustrated in FIG. 7(*b*), in the coin delivering device 3, the coin housing unit including coin tubes 6 typically is the cassette 5 separable from the coin delivering device main body 4 in order to easily pull out coins when the coins in the coin delivering device 3 are collected as sales. The cassette 5 separable typically includes the coin tubes 6, the coin base 7, and the payout slide 8. When the cassette 5 is separated from the coin delivering device main body 4, the engagement between the payout slide 8 and the payout link 9 through the pin 9*b* is released. In contrast, when the cassette 5 is fitted to the coin delivering device main body 4, the payout slide 8 included in the cassette 5 and the payout link 9 included in the coin delivering device main body 4 engage with each other through the pin 9*b*.

The conventional coin delivering device described above maximally delivers one coin from each of the coin tubes 6 in one time of the delivering operation.

CITATION LIST

Patent Literature

Patent Literature 1: JP 07-262426 A
Patent Literature 2: JP 11-161825 A

SUMMARY OF INVENTION

Technical Problem

In a coin delivering device, there is a general demand that delivering processing of change should be performed for as short a time as possible. A method of increasing delivering operation itself in speed can be thought in order to perform the delivering processing of change for a short time. However, with the method of increasing the delivering operation itself in speed, a harmful effect, such as a coin jam, easily occurs. Therefore, it is difficult to get a considerable increase in speed.

An object of the present invention is to provide a coin delivering device capable of increasing delivering processing of change in speed without causing the above harmful effect.

Solution to Problem

In order to solve the problem, a coin processing device of claim 1 includes: a plurality of coin tubes; a coin base provided below the plurality of coin tubes, and configured to support coins housed in the plurality of coin tubes in a standby mode; a payout slide including a plurality of coin housing holes corresponding to the plurality of coin tubes, separately, and configured to pull out the coins housed in the coin tubes, from slit holes open at bottom portions of the coin tubes; a payout link configured to engage with the payout slide and configured to reciprocate in a direction of pulling out the payout slide, with the payout slide when delivering operation of coins is performed; and a plurality of change slides provided corresponding to the plurality of coin tubes, separately, fitted and inserted into the payout link, in a case where the coins are delivered from the corresponding coin tubes, configured to move in response to the payout link when the payout slide is pulled out, and allow the coins housed in the coin housing holes to fall without closing lower portions of the coin housing holes, and in a case where the coins are not delivered from the corresponding coin tubes, configured not to move even when the payout slide is pulled out and the payout link moves, configured to prevent the coins housed in the coin housing holes from falling by closing the lower portions of the coin housing holes by upper surfaces of the change slides. At least one of the plurality of coin tubes is made to be a multiple-coin delivering coin tube from which a plurality of coins is pulled out in one time of pulling out the payout slide. A recess portion having a size for housing a coin, is provided at a position corresponding to the multiple-coin delivering coin tube, on the coin base, a vertical wall portion is provided around the coin housing hole corresponding to the multiple-coin delivering coin tube, on the payout slide, protrudes to a side of the coin base, and, in the standby mode, is positioned in the recess portion of the coin base, and an upper surface of the change slide corresponding to the multiple-coin delivering coin tube is positioned so as to be similar to a bottom surface of the recess portion of the coin base in height.

A coin processing device of claim 2 is the coin delivering device described in claim 1. A depth of the recess portion provided on the coin base is a thickness of one coin×(the number of coins to be pulled out at once−1), and a length between a lower end of the vertical wall portion provided on the payout slide and a lower surface of the payout slide is a thickness of one coin×(the number of coins to be pulled out at once−1).

A coin processing device of claim 3 is the coin delivering device described in claim 1 or the coin delivering device described in claim 2. The payout link into which the change slides have been fitted and inserted freely is attachable to and detachable from a main body.

Advantageous Effects of Invention

According to the present invention, a plurality of coins can be delivered from one coin tube in one time of delivering operation. Thus, delivering processing of change can be increased in speed.

BRIEF DESCRIPTION OF DRAWINGS

FIG. 7(*b*) is a sectional view of the main portion of the conventional coin delivering device in a state where a cassette has been separated.

DESCRIPTION OF EMBODIMENTS

One embodiment of the present invention will be described below based on FIGS. 1 to 5.

A structure of the coin delivering device according to the embodiment is the same as a structure of the conventional coin delivering device described above except portions to be described below. Thus, members in constituent members according to the embodiment, substantially the same as constituent members in the above conventional coin delivering device, are denoted with the same reference signs, and the detailed descriptions thereof will be omitted.

Figure 1:
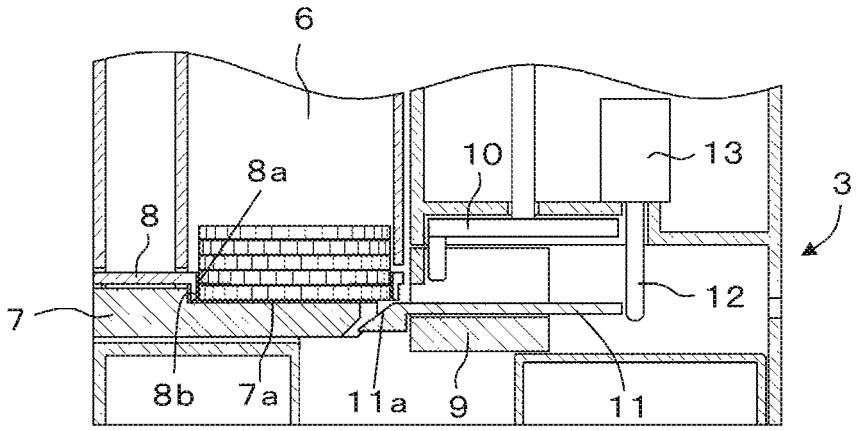
FIG. 1 is a sectional view of a main portion of a coin delivering device according to an embodiment of the present invention in a standby mode.

FIG. 1 is a sectional view of a main portion of the coin delivering device according to the embodiment of the present invention in a standby mode. The coin delivering device according to the embodiment includes five coin tubes 6. One of the coin tubes 6 is a two-coin delivering coin tube from which two coins are pulled out in one time of pulling out a payout slide 8. The other four are one-coin delivering coin tubes from which one coin is pulled out in one time of pulling out the payout slide 8 as in the conventional coin delivering device. FIG. 1 is the sectional view of the main portion including a portion corresponding to the two-coin delivering coin tube.

In the coin delivering device according to the embodiment, a recess portion 7*a* having a size enough for housing a coin, is provided at a position corresponding to a lower portion of the two-coin delivering coin tube 6, on a coin base 7. The depth of the recess portion 7*a* is approximately one coin out of coins to be housed in the two-coin delivering coin tube 6, in thickness. A vertical wall portion 8*b* protruding to the side of the coin base 7, is provided around a coin housing hole 8*a* corresponding to the two-coin delivering coin tube 6, on the payout slide 8. The length between a lower end of the vertical wall portion 8*b* and a lower surface of the payout slide 8 is approximately one coin out of the coins to be housed in the two-coin delivering coin tube 6, in thickness. The vertical wall portion 8*b* is positioned inside the recess portion 7*a* of the coin base 7 in the standby mode. A change slide 11 corresponding to the two-coin delivering coin tube 6 is fitted and inserted into a payout link 9 so that an upper surface of the change slide 11 is substantially the same as a bottom surface of the recess portion 7*a* provided to the coin base 7 in height.

In the standby mode, coins housed in the two-coin delivering coin tube 6 are supported by the bottom surface of the recess portion 7*a* of the coin base 7, and are housed inside the coin housing hole 8*a* of the payout slide 8 and the vertical wall portion 8*b* provided around the coin housing hole. With this configuration, there is no need for securing an additional space, and two-coin delivery can be performed.

Figure 2:
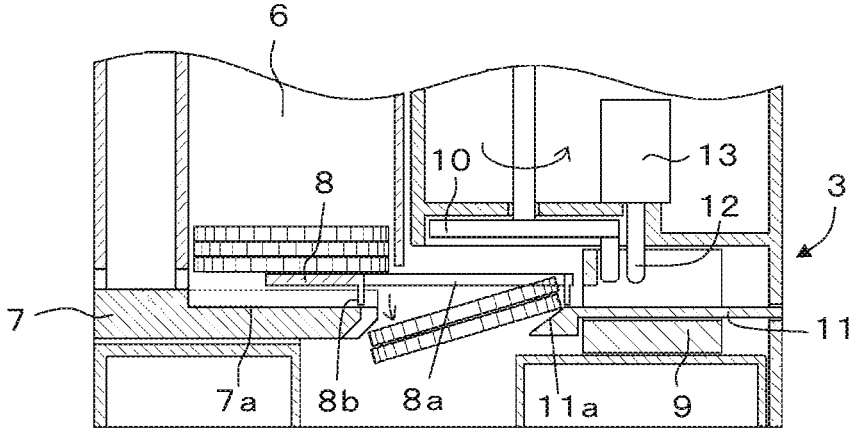
FIG. 2 is a sectional view of the main portion of the coin delivering device according to the embodiment of the present invention in a delivering mode.
Figure 2:
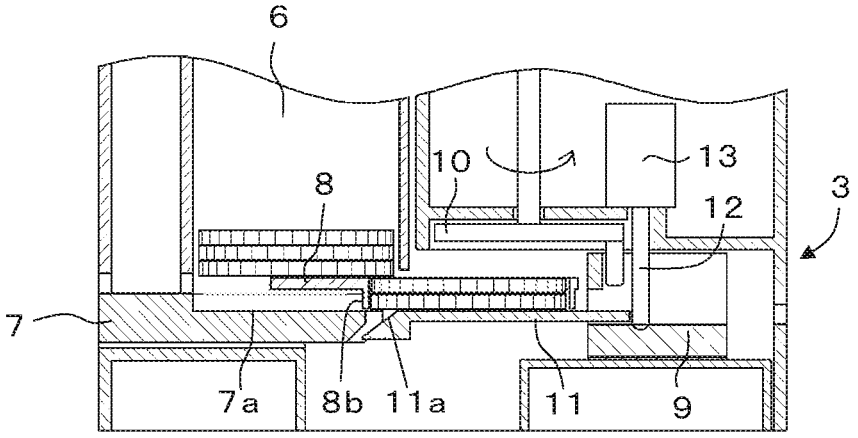

FIG. 2 is a sectional view of the main portion of the coin delivering device according to the embodiment of the present invention in a delivering mode. FIG. 2(*a*) illustrates a state where the change slide 11 has been allowing the coins housed in the coin housing hole 8*a* of the payout slide 8 to fall. FIG. 2(*b*) illustrates a state where the change slide 11 has been preventing the coins housed in the coin housing hole 8*a* of the payout slide 8 from falling.

In the delivering mode, the payout slide 8 moves in a direction of the side of a rear surface of a device main body together with the payout link 9 (a right direction in FIG. 2). In this case, two coins housed in the coin housing hole 8*a* of the payout slide 8 and the vertical wall portion 8*b* provided around the coin housing hole 8*a*, move together with the payout slide 8.

In a case where delivery of coins is performed from the corresponding two-coin delivering coin tube 6, the change slide 11 moves in response to the payout link 9. A lower portion of the coin housing hole 8*a* of the payout slide 8 opens. A state where the change slide 11 has been allowing the coins housed in the coin housing hole 8*a* of the payout slide 8 to fall, is acquired. In this state, the two coins housed in the coin housing hole 8*a* of the payout slide 8 and the vertical wall portion 8*b* provided around the coin housing hole 8*a*, fall and are delivered. Note that, a slant 11*a* is provided at a leading end portion of the change slide 11. When the coins fall, end portions on the side of the change slide 11 of the coins come in contact with the slant ha so that the coins fall from the side of the coin base 7. Accordingly, even in a case of the two-coin delivery, the coins can stably fall.

Meanwhile, in a case where the delivery of coins is not performed from the corresponding two-coin delivering coin tube 6, the change slide 11 does not respond to the payout link 9, and retains the position in the standby mode. An upper surface of the change slide 11 closes the lower portion of the coin housing hole 8*a* of the payout slide 8. A state where the change slide 11 has been preventing the coins housed in the coin housing hole 8*a* of the payout slide 8 from falling, is acquired. In this state, the two coins housed in the coin housing hole 8*a* of the payout slide 8 and the vertical wall portion 8*b* provided around the coin housing hole 8*a*, are supported by the upper surface of the change slide 11 so as not to be delivered.

Figure 3:
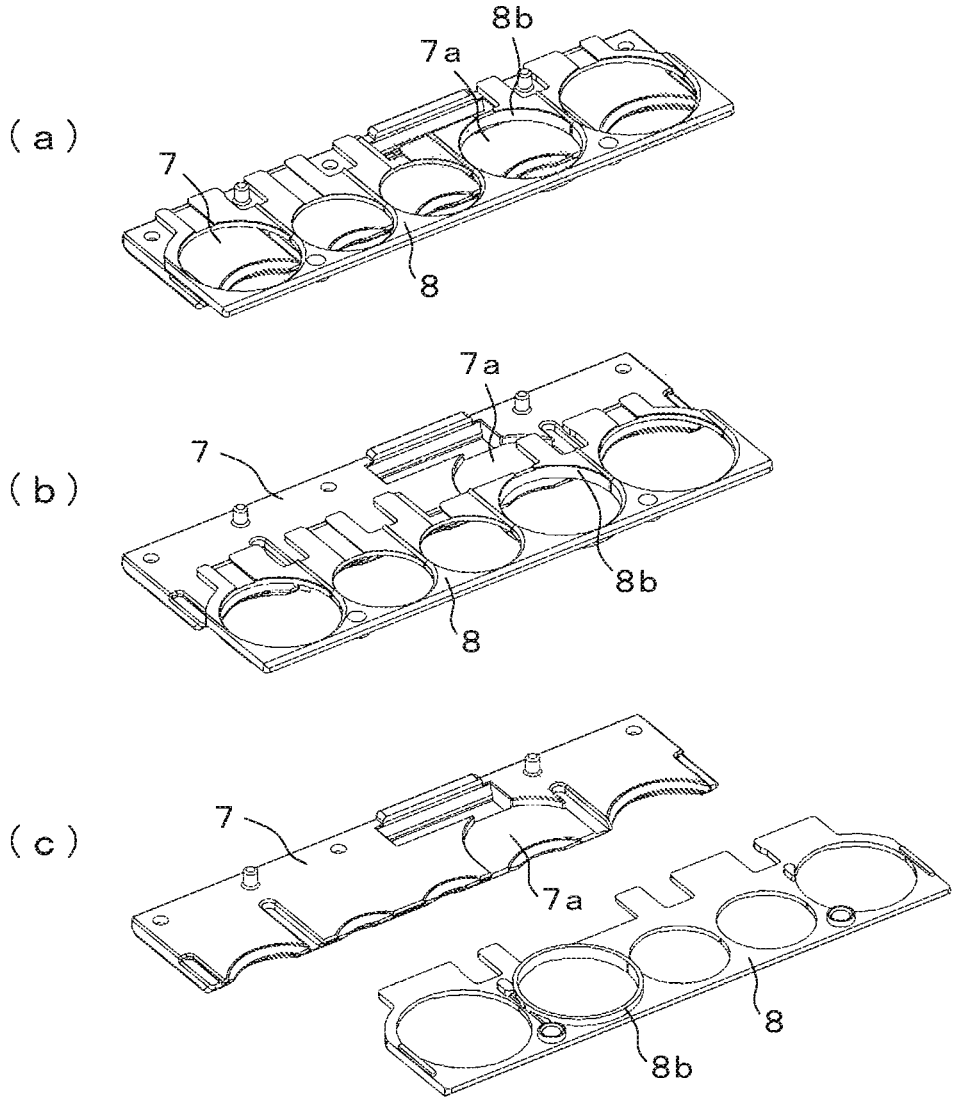
FIG. 3 is a perspective view of a coin base and a payout slide of the coin delivering device according to the present invention.

FIG. 3 is a perspective view of the coin base 7 and the payout slide 8 of the coin delivering device according to the embodiment of the present invention. FIG. 3(*a*) illustrates positional relationship between the coin base 7 and the payout slide in the standby mode. FIG. 3(*b*) illustrates positional relationship between the coin base 7 and the payout slide 8 in the delivering mode. FIG. 3(*c*) illustrates the respective back sides of the coin base 7 and the payout slide 8.

Figure 4:
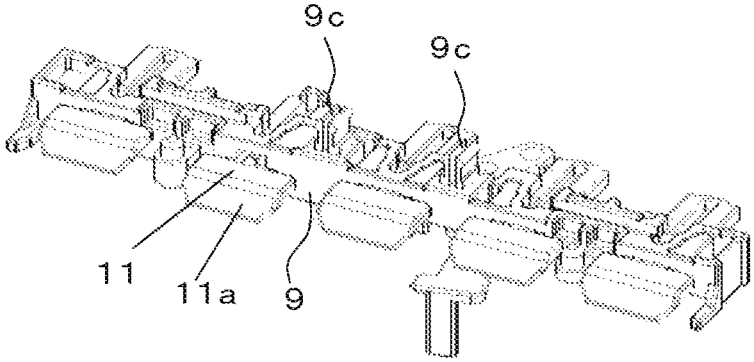
FIG. 4 is a perspective view of a payout link and a change slide of the coin delivering device according to the embodiment of the present invention.

FIG. 4 is a perspective view of the payout link 9 and change slides 11 of the coin delivering device according to the embodiment of the present invention. In FIG. 4, a second change slide 11 from the left side is the change slide 11 corresponding to the two-coin delivering coin tube 6. The upper surface of the change slide 11 corresponding to the second-coin delivering coin tube 6 is lower than upper surfaces of the other change slides by one coin in thickness. The payout link 9 includes a fitting protrusion 9*c* for allowing the payout link 9 to fit to the device main body so as to be freely attachable and detachable, provided thereto.

Figure 5:
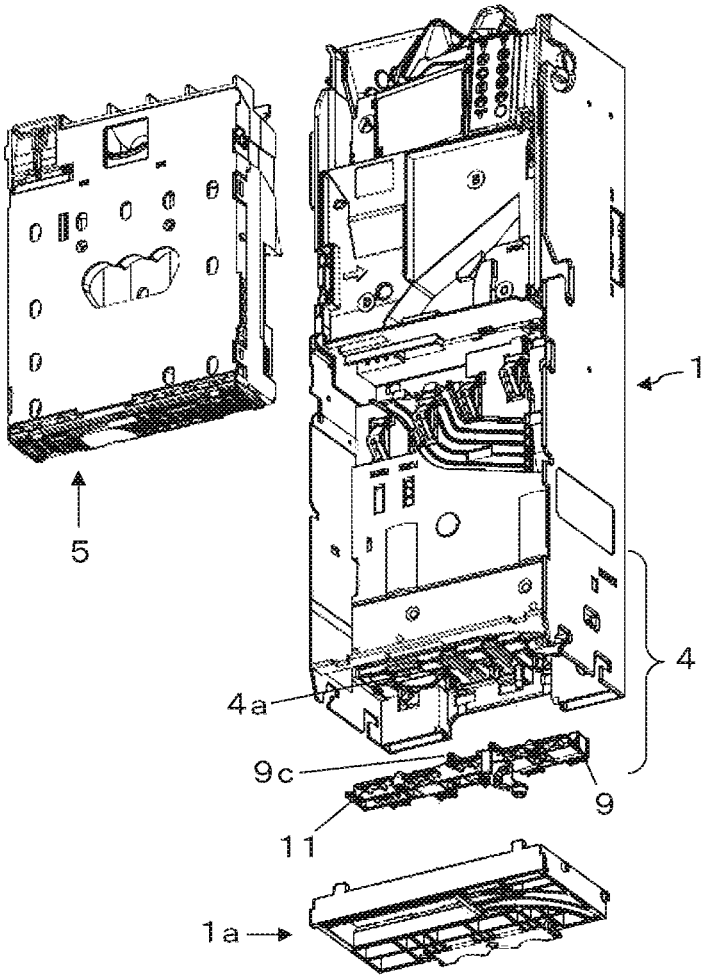
FIG. 5 is a perspective view of the coin delivering device according to the embodiment of the present invention in a state where the payout link has been separated from a device main body.
Figure 6:
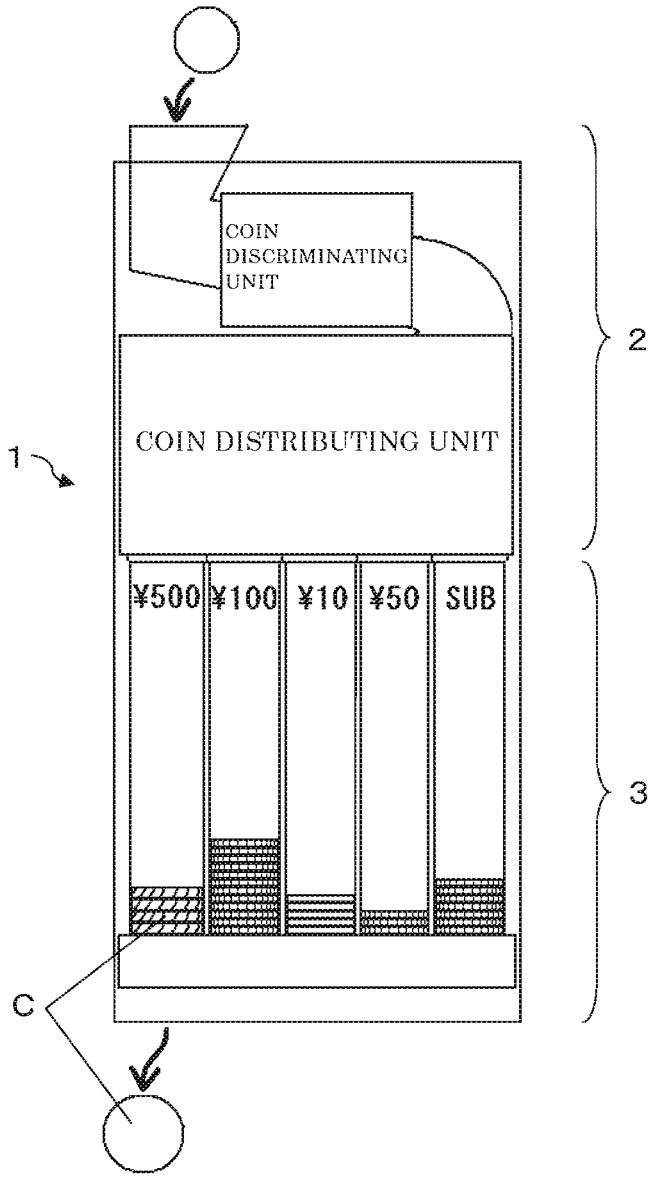
FIG. 6 is a schematic view of a conventional coin processing device.
Figure 7:
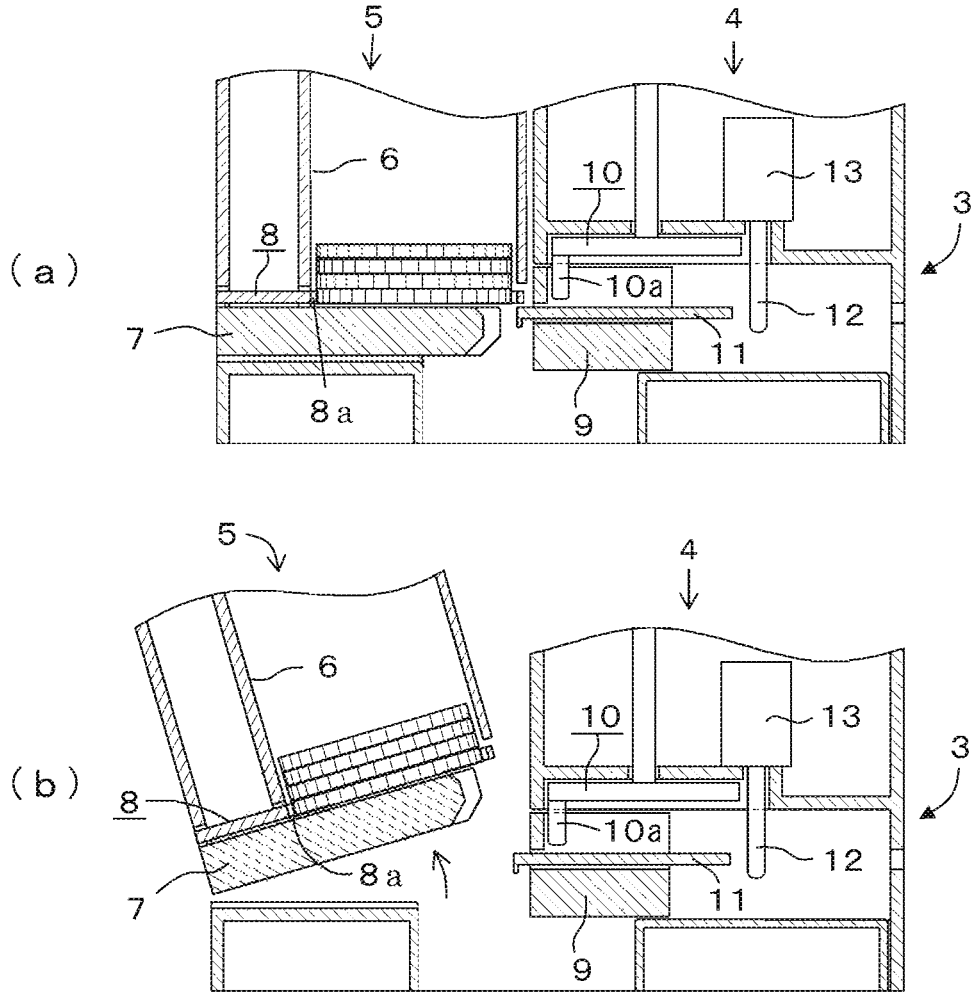
FIG. 7(*a*) is a sectional view of a main portion of a conventional coin delivering device in a standby mode.
Figure 8:
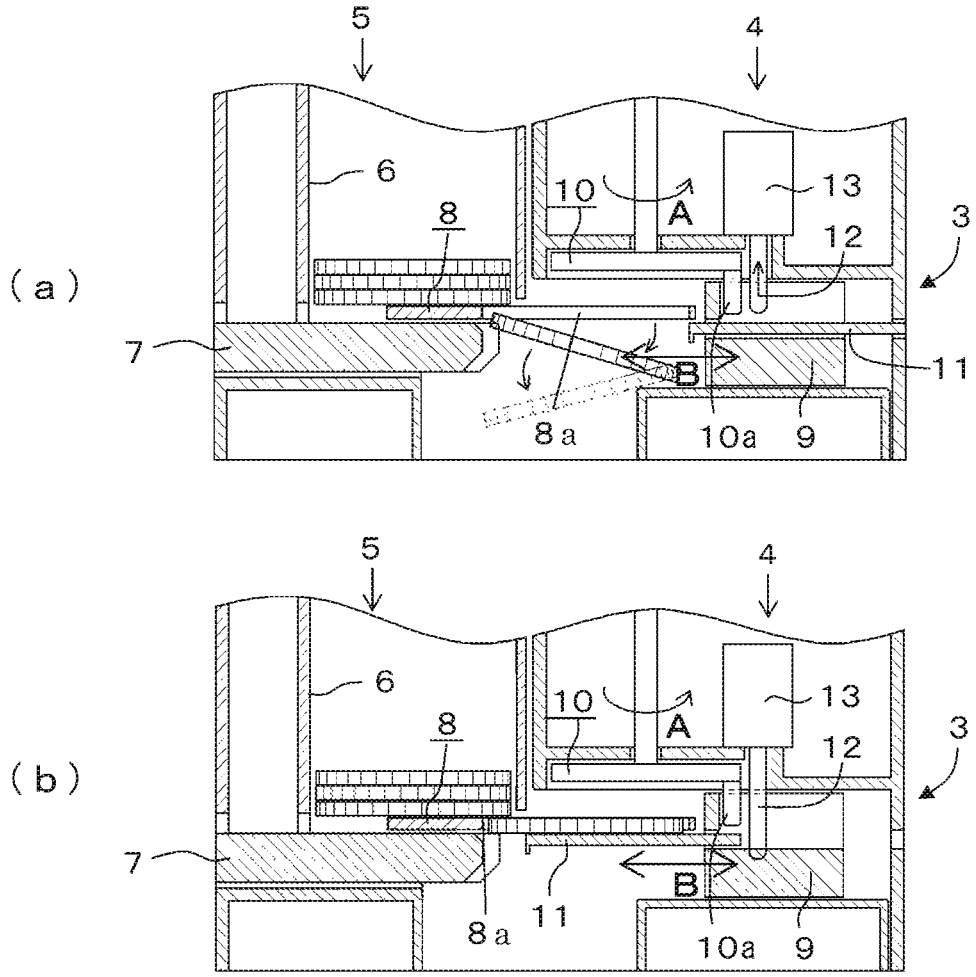
FIG. 8 is a sectional view of the main portion of the conventional coin delivering device in a delivering mode.
Figure 9:
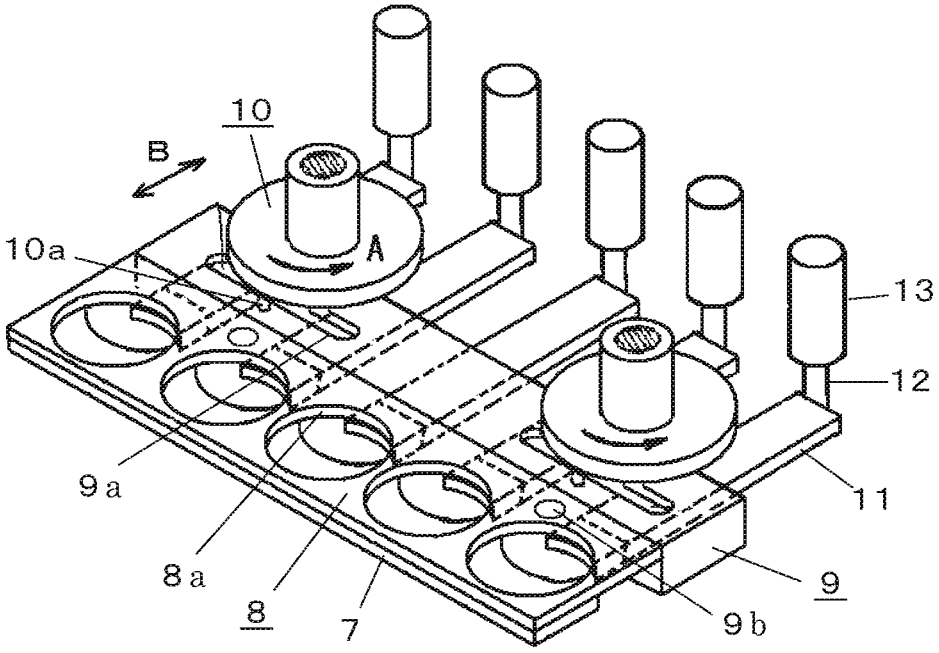
FIG. 9 is a conceptual perspective view of the conventional coin delivering device.

FIG. 5 is a perspective view of the coin delivering device according to the embodiment of the present invention in a state where the payout link 9 has been separated from the device body. FIG. 5 illustrates a coin processing device 1 in which the coin delivering device 4 has been installed. A cassette 5 including a coin-tube main body, a bottom portion la of the coin processing device, and the payout link 9 have been separated from the coin processing device 1. A main body of the coin delivering device 4 includes a fitting groove 4*a* for allowing the payout link 9 to be freely attachable and detachable, provided thereto. The fitting protrusion 9*c* provided to the payout link 9 is inserted into the fitting groove 4*a*. Thus, the payout link 9 is fitted to the main body of the coin delivering device 4 so as to be attachable and detachable. In this manner, making the payout link 9 attachable to and detachable from the main body of the coin delivering device 4, can easily handle even a case where the number or a position of the two-coin delivering tube 6 is changed, by changing the payout link 9.

The coin delivering device according to the above embodiment can deliver two coins from one coin tube in one time of the delivering operation. Thus, delivering processing of change can increase in speed. In addition, the number of times of the delivering operation and a period of the delivering operation decrease. Thus, life spans of driving components in the coin delivering device can be prolonged.

The one embodiment of the present invention has been described above. The coin processing device according to the present invention is not limited to the embodiment.

The coin delivering device according to the above embodiment includes one two-coin delivering coin tube provided thereto, but may include two two-coin delivering coin tubes or more provided thereto. The coin delivering device according to the above embodiment includes the two-coin delivering coin tube from which two coins are pulled out in one time of pulling out the payout slide, provided thereto, but may include a multiple-coin delivering coin tube from which three coins or more are pulled out in one time of pulling out the payout slide, provided thereto. In this case, the depth of the recess portion provided on the coin base is made to be the thickness of one coin×(the number of coins to be pulled out at once−1). The length between the lower end of the vertical wall portion provided on the payout slide and the lower surface of the payout slide is made to be the thickness of one coin×(the number of coins to be pulled out−1).

REFERENCE SIGNS LIST

1 coin processing device
1*a* bottom portion
2 coin sorting device
3 coin housing device
4 coin delivering device
4*a* fitting groove
5 cassette (coin-tube main body)
6 coin tube
7 coin base
7*a* recess portion
8 payout slide
8*a* coin housing hole
8*b* vertical wall portion
9 payout link
9*c* fitting protrusion
10 payout cam
11 change slide
12 change lever
13 solenoid for change lever
C coin

The invention claimed is:

1. A coin delivering device included in a part of a coin processing device that sorts and houses each denomination of inserted coins and further delivers the coins that have been housed in response to an amount of change, the coin delivering device comprising:

a plurality of coin tubes;

a coin base provided below the plurality of coin tubes, and configured to support coins housed in the plurality of coin tubes in a standby mode;

a payout slide including a plurality of coin housing holes corresponding to the plurality of coin tubes, separately, and configured to pull out the coins housed in the coin tubes, from slit holes open at bottom portions of the coin tubes;

a payout link configured to engage with the payout slide and configured to reciprocate in a direction of pulling out the payout slide, with the payout slide when delivering operation of coins is performed; and a plurality of change slides provided corresponding to the plurality of coin tubes, separately, fitted and inserted into the payout link, in a case where the coins are delivered from the corresponding coin tubes, configured to move in response to the payout link when the payout slide is pulled out, and allow the coins housed in the coin housing holes to fall without closing lower portions of the coin housing holes, and in a case where the coins are not delivered from the corresponding coin tubes, configured not to move even when the payout slide is pulled out and the payout link moves, configured to prevent the coins housed in the coin housing holes from falling by closing the lower portions of the coin housing holes by upper surfaces of the change slides, wherein for at least one of the denomination, a one-coin delivering coin tube from which one coin is pulled out in one time of pulling out the payout slide, and a multiple-coin delivering coin tube from which a plurality of coins is pulled out in one time of pulling out the payout slide, are each provided, a recess portion having a size for housing a coin, is provided at a position corresponding to the multiple-coin delivering coin tube, on the coin base, a vertical wall portion is provided around the coin housing hole corresponding to the multiple-coin delivering coin tube, on the payout slide, protrudes to a side of the coin base, and, in the standby mode, is positioned in the recess portion of the coin base, and an upper surface of the change slide corresponding to the multiple-coin delivering coin tube is positioned so as to be similar to a bottom surface of the recess portion of the coin base in height.

2. The coin delivering device according to claim 1, wherein the payout link into which the change slides have been fitted and inserted freely is attachable to and detachable from a main body.

3. The coin delivering device according to claim 1, wherein the upper surface of the change slide corresponding to the multiple-coin delivering coin tube is lower than an upper surfaces of the change slide corresponding to the one-coin delivering tube by one coin in thickness.

4. The coin delivering device according to claim 1, wherein a depth of the recess portion provided on the coin base is a thickness of one coin×(the number of coins to be pulled out at once−1), and a length between a lower end of the vertical wall portion provided on the payout slide and a lower surface of the payout slide is a thickness of one coin×(the number of coins to be pulled out at once−1).

5. The coin delivering device according to claim 4, wherein the payout link into which the change slides have been fitted and inserted freely is attachable to and detachable from a main body.

* * * * *